US012004575B2

(12) United States Patent
Martinet et al.

(10) Patent No.: US 12,004,575 B2
(45) Date of Patent: Jun. 11, 2024

(54) BRASSIERE AND MANUFACTURING METHOD THEREOF

(71) Applicant: Regina Miracle International (Group) Limited, Hong Kong (CN)

(72) Inventors: Nathalie Martinet, Hong Kong (CN); Suet Hing Yip, Hong Kong (CN); Changming Liang, Hong Kong (CN)

(73) Assignee: Regina Miracle International (Group) Limited, Hong Kong (CN)

( * ) Notice: Subject to any disclaimer, the term of this patent is extended or adjusted under 35 U.S.C. 154(b) by 173 days.

(21) Appl. No.: 17/636,267

(22) PCT Filed: Aug. 20, 2019

(86) PCT No.: PCT/CN2019/101485
§ 371 (c)(1),
(2) Date: Feb. 17, 2022

(87) PCT Pub. No.: WO2021/031097
PCT Pub. Date: Feb. 25, 2021

(65) Prior Publication Data
US 2022/0273050 A1 Sep. 1, 2022

(51) Int. Cl.
*A41C 3/12* (2006.01)
*A41C 3/00* (2006.01)

(52) U.S. Cl.
CPC ..... *A41C 3/128* (2013.01); *A41C 3/0028* (2013.01)

(58) Field of Classification Search
None
See application file for complete search history.

(56) References Cited

U.S. PATENT DOCUMENTS 3,772,899 A * 11/1973 Novi ..... D04B 1/246 450/39
5,626,507 A * 5/1997 Gillen ..... A41C 3/105 2/268
5,850,745 A * 12/1998 Albright ..... D04B 1/246 2/73
5,914,166 A * 6/1999 Le ..... A41F 15/02 2/268

(Continued)

FOREIGN PATENT DOCUMENTS

CN 105520204 A 4/2016
CN 105996158 A 10/2016
CN 206101607 U 4/2017

OTHER PUBLICATIONS

Authorized Officer: Guo, Junhong, International Search Report and Written Opinion issued in PCT application No. PCT/CN2019/101485, dated May 18, 2020, 8 pp.

*Primary Examiner* — Jocelyn Bravo
(74) *Attorney, Agent, or Firm* — Kaplan Breyer Schwarz, LLP

(57) ABSTRACT

A brassiere to be worn by a wearer is disclosed. The brassiere includes a pair of bra cups. The brassiere also includes at least one side wing attached to lateral peripheries of the pair of bra cups to support the brassiere around a torso of the wearer, when worn. The brassiere further includes a pair of straps attached to top peripheries of the pair of bra cups to support the brassiere on shoulders of the wearer, when worn. Herein, at least one of the at least one side wing and the pair of straps comprise one or more flat-knit fabric layers.

18 Claims, 9 Drawing Sheets

(56) References Cited

U.S. PATENT DOCUMENTS

| | | | | |
|---|---|---|---|---|
| 6,227,011 | B1 * | 5/2001 | Cortinovis | A41D 20/00 66/8 |
| 7,833,085 | B2 * | 11/2010 | Crouch | A41F 15/02 450/86 |
| 8,869,314 | B2 * | 10/2014 | Peper | A41D 27/08 2/310 |
| 9,375,045 | B2 * | 6/2016 | Farris | D04B 1/24 |
| 10,368,590 | B2 * | 8/2019 | Diaz | D04B 35/10 |
| 11,484,068 | B2 * | 11/2022 | Diaz | A41C 3/0085 |
| 2006/0243000 | A1 * | 11/2006 | Turlan | D04B 21/18 66/62 |
| 2008/0032599 | A1 * | 2/2008 | Kaye | A41F 15/02 450/86 |
| 2008/0127683 | A1 * | 6/2008 | Duckham | A41C 3/0014 450/86 |
| 2009/0117826 | A1 * | 5/2009 | Crouch | A41F 15/02 450/86 |
| 2010/0068972 | A1 * | 3/2010 | Hendrickson | A41D 1/215 450/36 |
| 2011/0230120 | A1 * | 9/2011 | Tully | A41F 15/00 450/88 |
| 2011/0300774 | A1 | 12/2011 | Smith | |
| 2012/0324631 | A1 * | 12/2012 | Peper | A41F 15/02 2/244 |
| 2015/0082662 | A1 * | 3/2015 | Farris | A41F 9/002 2/322 |
| 2015/0111466 | A1 * | 4/2015 | Martinet | A41C 3/065 450/41 |
| 2017/0099884 | A1 * | 4/2017 | Martinet | A41C 3/10 |
| 2017/0119063 | A1 * | 5/2017 | Diaz | D04B 1/106 |
| 2018/0310643 | A1 | 11/2018 | Hanson Allen et al. | |
| 2019/0174841 | A1 | 6/2019 | Bastug | |
| 2019/0297956 | A1 * | 10/2019 | Diaz | D04B 1/246 |

* cited by examiner

BRASSIERE AND MANUFACTURING METHOD THEREOF

FIELD OF THE PRESENT DISCLOSURE

The present disclosure generally relates to brassieres, and in particular to brassieres which can adjust itself to different body sizes under same bra cup size.

BACKGROUND

A brassiere (bra) is worn by a wearer to be held firmly in place against her body and support her breasts in their proper position without exerting excessive pressure against them. The bra generally comprises a pair of bra cups, and further comprises at least one side wing and a pair of shoulder straps. Traditionally bras are made available in various sizes, with the bra cups typically being of different standard sizes. It may be possible that two different wearers wearing bras with same standard size bra cups may find that the respective bras fit differently to them, depending on shape of their body, or specifically their breasts and upper torso. In other words, wearers who wear bras of the same cup size may have different body sizes and therefore may require different elongation of the side wing(s) and/or shoulder straps. With conventional shoulder side wings and shoulder straps, wearers of a particular bra cup size may be of such a body size that they may feel that the side wings and shoulder straps are too tight, because of the force required to elongate the side wings or shoulder strap to a required extent.

Accordingly, there is a need of a brassiere with shoulder straps and side wings providing sufficient elongation such that wearers of different body sizes wearing a particular bra cup size would likely still feel comfortable despite the different body sizes, and thus provide comfortable and care-free experience for the wearer when the brassiere is worn.

SUMMARY

In one aspect, a brassiere to be worn by a wearer is disclosed. The brassiere includes a pair of bra cups. The brassiere also includes at least one side wing attached to lateral peripheries of the pair of bra cups to support the brassiere around a torso of the wearer, when worn. The brassiere further includes a pair of straps attached to top peripheries of the pair of bra cups to support the brassiere on shoulders of the wearer, when worn. Herein, at least one of the at least one side wing and the pair of straps comprise one or more flat-knit fabric layers.

In one or more embodiments, each of the at least one side wing and each strap of the pair of straps comprise one flat-knit fabric layer therein.

In one embodiment, each of the at least one side wing comprises a fabric sheet folded to provide a folded region and a free ends region, and the flat-knit fabric layer is enclosed within the folded region.

In one embodiment, the flat-knit fabric layer is attached to the fabric sheet at the folded region using an adhesive.

In one embodiment, the adhesive is in the form of an adhesive film arranged between the flat-knit fabric layer and the fabric sheet.

In one embodiment, free ends of the fabric sheet at the free ends region are attached to each other using an adhesive.

In one embodiment, each strap in the pair of straps comprises a fabric sheet folded to provide a tubular structure, and the flat-knit fabric layer is enclosed within the tubular structure of the fabric sheet.

In one embodiment, the flat-knit fabric layer is attached to the fabric sheet using an adhesive.

In one embodiment, the adhesive is in the form of an adhesive film arranged between the flat-knit fabric layer and the fabric sheet.

In one or more embodiments, each of the one or more flat-knit fabric layers is composed of an elastic covered yarn material.

Preferably, each of the one or more flat-knit fabric layers is composed of nylon or spandex covered polyester yarn material.

In one or more embodiments, an amount of yarn material utilized for forming a section of each of the one or more flat-knit fabric layers varies for different sections.

In one or more embodiments, different types of yarn materials are utilized for forming different sections of each of the one or more flat-knit fabric layers.

In another aspect, a method of manufacturing a brassiere is disclosed. The method comprises forming at least one side wing and a pair of straps, with each of the at least one side wing and each strap of the pair of straps comprising one flat-knit fabric layer therein. The method further comprises providing a pair of bra cups. The method further comprises attaching the at least one side wing to lateral peripheries of the pair of bra cups to support the brassiere around a torso of the wearer, when worn. The method further comprises attaching the pair of straps to top peripheries of the pair of bra cups to support the brassiere on shoulders of the wearer, when worn.

In one embodiment, forming each of the at least one side wing comprises folding a fabric sheet to provide a folded region and a free ends region, with the flat-knit fabric layer enclosed within the folded region; and attaching the flat-knit fabric layer to the fabric sheet at the folded region and the free ends of the fabric sheet at the free ends region using an adhesive.

In one embodiment, forming each strap of the pair of straps comprises folding a fabric sheet to provide a tubular structure, with the flat-knit fabric layer enclosed within the tubular structure of the fabric sheet; and attaching the flat-knit fabric layer to the fabric sheet using an adhesive.

In one embodiment, each of the flat-knit fabric layers is composed of an elastic covered yarn material.

Preferably, each of the flat-knit fabric layers is composed of nylon or spandex covered polyester yarn material.

In one or more embodiments, the method further comprises varying an amount of yarn material in different sections of the flat-knit fabric layers.

In one or more embodiments, the method further comprises utilizing different yarn materials in different sections of the flat-knit fabric layers.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

For a more complete understanding of example embodiments of the present disclosure, reference is now made to the following descriptions taken in connection with the accompanying drawings in which:

FIG. 12 illustrates a graph representing elongation in fabric material with the flat-knit fabric layer implemented in a strap of a typical bra in accordance with one or more embodiments of the present disclosure.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced item. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Where reference herein is made to interior and exterior or similar terminology in relation to component parts or items of the bra or part of the bra, it is meant to be understood to be in relation to the body of the wearer of the bra. For example, the "interior" or "inner side" or "inner region" is a relative term to denote that an item is more proximate the face side of the bra that is more proximate to the body of the wearer than items of the bra that are more distal the body of the wearer. "Inner" does not mean "inner most" unless specified. This similarly applies to terms such as "outer" or "exterior".

Where there is reference to the word "layer" it is to be understood that it may have its common definition and, but not limited to that the layer could consist of one panel or may have regions that are defined by two or more panels that are joined and that may each be of a different characteristic (e.g. color, thickness, material, orientation, size).

Figure 1:
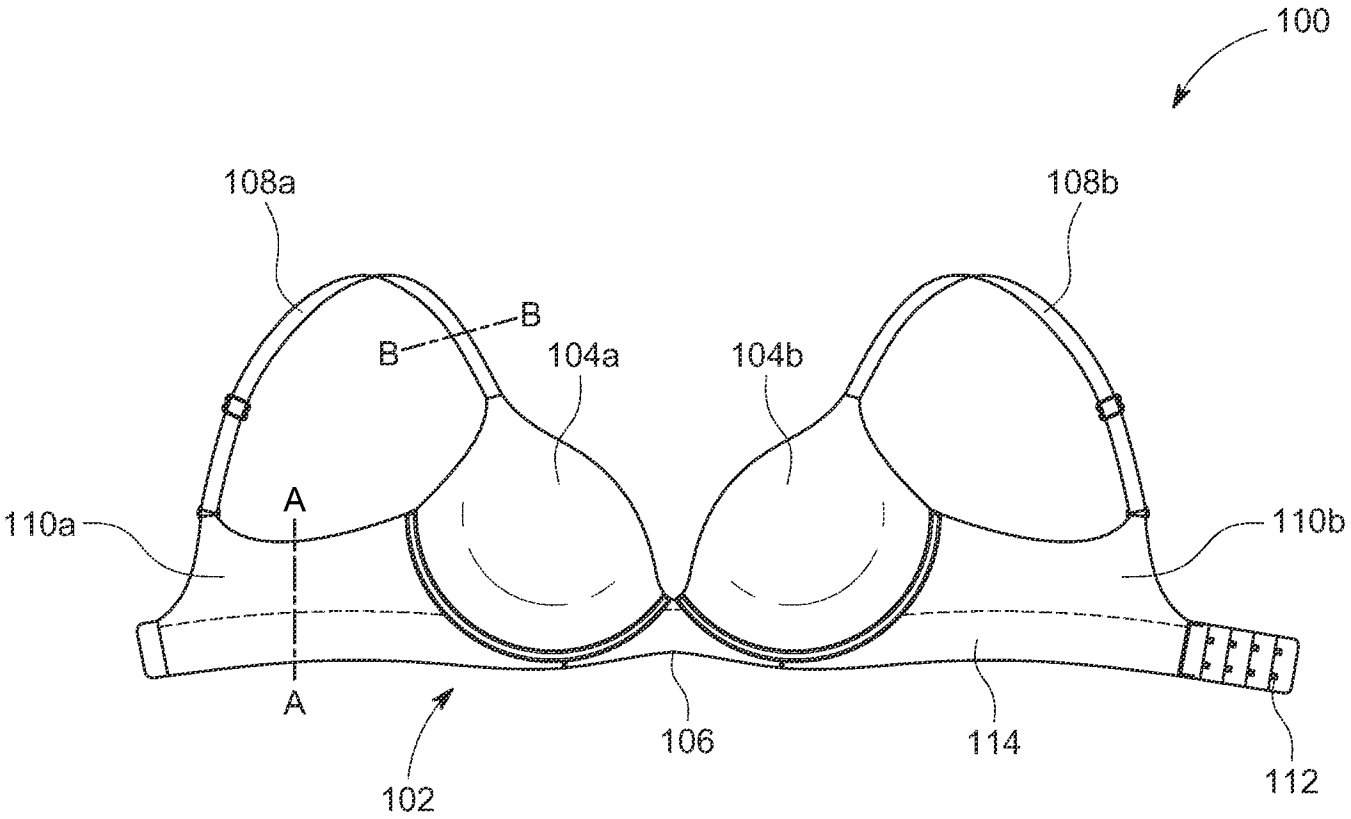
FIG. 1 illustrates a diagrammatic view of a brassiere, in accordance with a first embodiment of the present disclosure.

Referring to the drawings, FIG. 1 illustrates a diagrammatic view of a brassiere 100 (also, sometimes simply referred to as "bra 100"), in accordance with a first embodiment of the present disclosure. In particular, FIG. 1 illustrates a body structure 102 of the brassiere 100. As illustrated, the body structure 102 defines two bra cups that are generally identical to each other and are positioned adjacent to each other. As shown in FIG. 1, the body structure 102 includes a pair of bra cups, with a first bra cup 104*a* and a second bra cup 104*b* (sometimes commonly referred by the numeral 104 hereinafter). A center gore 106 is extending between and connects the first bra cup 104*a* and the second bra cup 104*b*.

In the illustrated embodiment of FIG. 1, the bra 100 includes a pair of straps, including a first strap 108*a* and a second strap 108*b*. As illustrated, the first strap 108*a* and the second strap 108*b* are attached to top peripheries of the first bra cup 104*a* and the second bra cup 104*b*, respectively. Further, the bra 100 includes a pair of side wings, including a first side wing 110*a* and a second side wing 110*b* (sometimes commonly referred by the numeral 110 hereinafter). As illustrated, the first side wing 110*a* and the second side wing 110*b* are attached to lateral peripheries of the first bra cup 104*a* and the second bra cup 104*b*, respectively. It may be contemplated that the pair of straps 108*a* and 108*b* support the brassiere 100 on shoulders of the wearer, while the pair of side wings 110*a* and 110*b* support the brassiere 100 around a torso of the wearer, when worn. In some examples, the pair of straps 108*a* and 108*b* may not be provided and only the pair of side wings 110*a* and 110*b* may support the brassiere 100 on the wearer. Further, in one or more examples, one or more fasteners 112 may be provided with one or more of the first side wing 110*a* and the second side wing 110*b*.

According to embodiments of the present disclosure, at least one of the at least one side wing and the pair of straps comprise one or more flat-knit fabric layers. In the embodiment of FIG. 1, each of the first side wing 110*a* and the second side wing 110*b* and further each of the first strap 108*a* and the second strap 108*b* include one flat-knit fabric layer (only shown for the side wings 110 and generally represented by numeral 114) therein. Herein, by the term "flat-knit" is meant a knitted fabric, obtained by a machine with one or two needle beds, a so-called flat knitting machine. The process according to the present disclosure is advantageously a process for making fabric on a flat knitting machine, particularly a Raschel Jacquard knitting machine or a multi-bar of the type marketed by the Karl Mayer Company. These knitting machines use computerized management of knitting programs so that a large variety of products can be made.

In one example, the flat-knit relates to a right/left-bound knit. By the term "right/left-bound knit" in the present disclosure is meant a knitted fabric which comprises only knit right stitches at the front and only purl left stitches at the rear, or alternately comprises a row of knit right stitches and a row of purl left stitches. In such example, the front and rear sides, therefore, might have a different appearance. In another example, the flat-knit relates to a rib-bound knit. By the term "rib-bound knit" in the present disclosure is meant a knitted fabric which alternately comprises a number of knit right stitches and a number of purl left stitches. Such structure may show clear vertical ribs. In yet other example, the flat-knit relates to an interlock knit. By the term "interlock knit" in the present disclosure is meant a knitted fabric which comprises two rib-bound knitted fabrics which are knitted together. The front and rear look the same and only show knit right stitches. In such example, the purl left stitches of the one knitted fabric are covered by the knit right stitches of the other knitted fabric. In still other example, the flat-knit relates to a single bed interlock knit. By the term "single bed interlock knit" in the present disclosure is meant a flat knit which is knitted on a single bed, wherein one row is knitted on even needles and one row on odd needles. In such example, the front and rear side have a different appearance.

Figure 3:
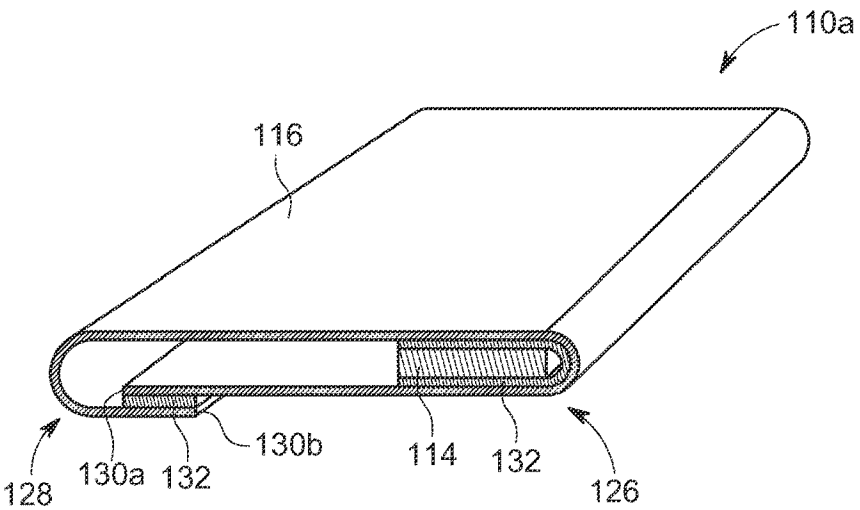
FIG. 3 illustrates a diagrammatic section view of a side wing of the brassiere of FIG. 1 along section AA' thereof, in accordance with another embodiment of the present disclosure.
Figure 2:
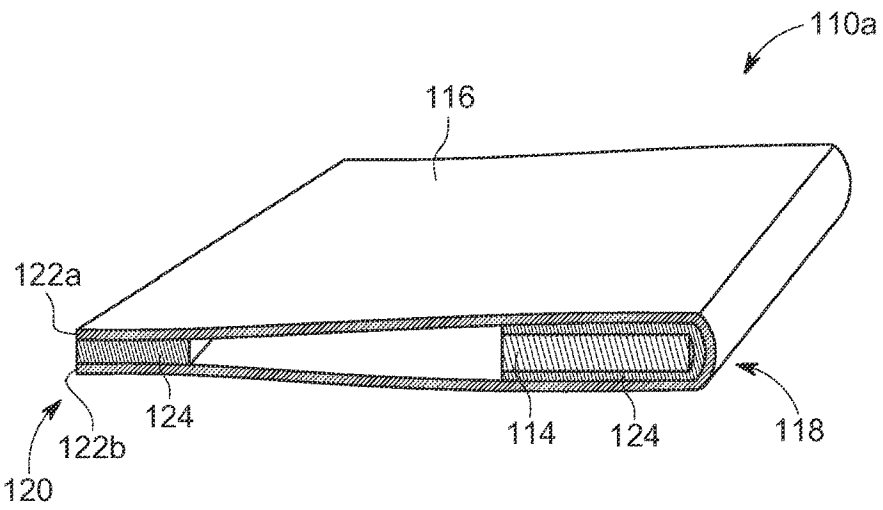
FIG. 2 illustrates a diagrammatic section view of a side wing of the brassiere of FIG. 1 along section AA' thereof, in accordance with an embodiment of the present disclosure.

Referring now to FIGS. 2-3, illustrated are diagrammatic section views of a side wing 110*a* of the brassiere of FIG. 1 along section AA' thereof, in accordance with two different embodiments of the present disclosure. In particular, in the illustrated embodiment of FIG. 2, the fabric sheet 116 is folded once to provide a folded region 118 and a free ends region 120 with free ends 122*a* and 122*b*. As shown, the flat-knit fabric layer 114 is enclosed within the folded region 118 of the fabric sheet 116. By "enclosed" herein is meant that the flat-knit fabric layer 114 being a generally rectangular structure is at least covered from three of its sides by the fabric sheet 116. Further, the flat-knit fabric layer 114 is attached to the fabric sheet 116 at the folded region 118 using an adhesive 124. Further, the free ends 122*a* and 122*b* of the fabric sheet 116 at the free ends region 120 are attached to each other using the same adhesive 124. In one or more examples, the adhesive 124 is in the form of an adhesive film arranged between the flat-knit fabric layer 114 and the fabric sheet 116.

Further, in the illustrated embodiment of FIG. 3, the fabric sheet 116 is folded twice to provide a folded region 126 and a free ends region 128 with free ends 130*a* and 130*b*. As shown, the flat-knit fabric layer 114 is enclosed within the folded region 126 of the fabric sheet 116. As discussed previously, by "enclosed" herein is meant that the flat-knit fabric layer 114 being a generally rectangular structure is at least covered from three of its sides by the fabric sheet 116. Further, the flat-knit fabric layer 114 is attached to the fabric sheet 116 at the folded region 126 using an adhesive 132. Further, the free ends 130*a* and 130*b* of the fabric sheet 116 at the free ends region 128 are attached to each other using the same adhesive 132. In one or more examples, the adhesive 132 is in the form of an adhesive film arranged between the flat-knit fabric layer 114 and the fabric sheet 116.

Figure 4:
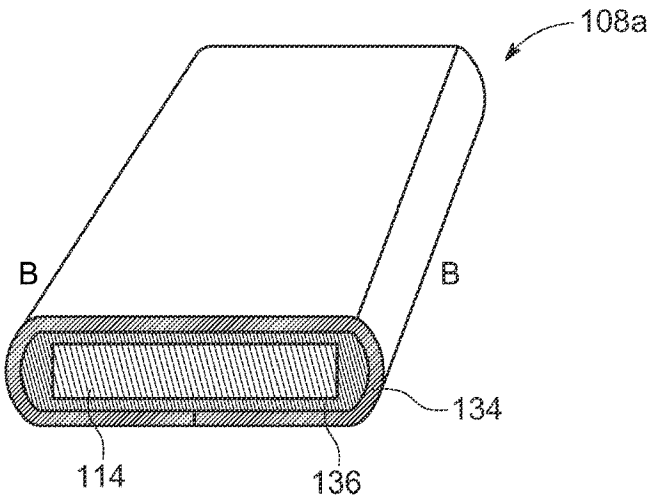
FIG. 4 illustrates a diagrammatic section view of a strap of the brassiere of FIG. 1 along section BB' thereof, in accordance with an embodiment of the present disclosure.

Further referring to FIG. 4, illustrated is a diagrammatic section view of the strap 108*a* of the bra 100 of FIG. 1 along section BB' thereof. As illustrated, the strap 108*a* includes a fabric sheet 134 folded to provide a tubular structure. Herein, the flat-knit fabric layer 114 is enclosed within the tubular structure of the fabric sheet 116. Furthermore, the flat-knit fabric layer 114 is attached to the fabric sheet 116 using an adhesive 136. In one or more examples, the adhesive 136 is in the form of an adhesive film arranged between the flat-knit fabric layer 114 and the fabric sheet 134.

Figure 5:
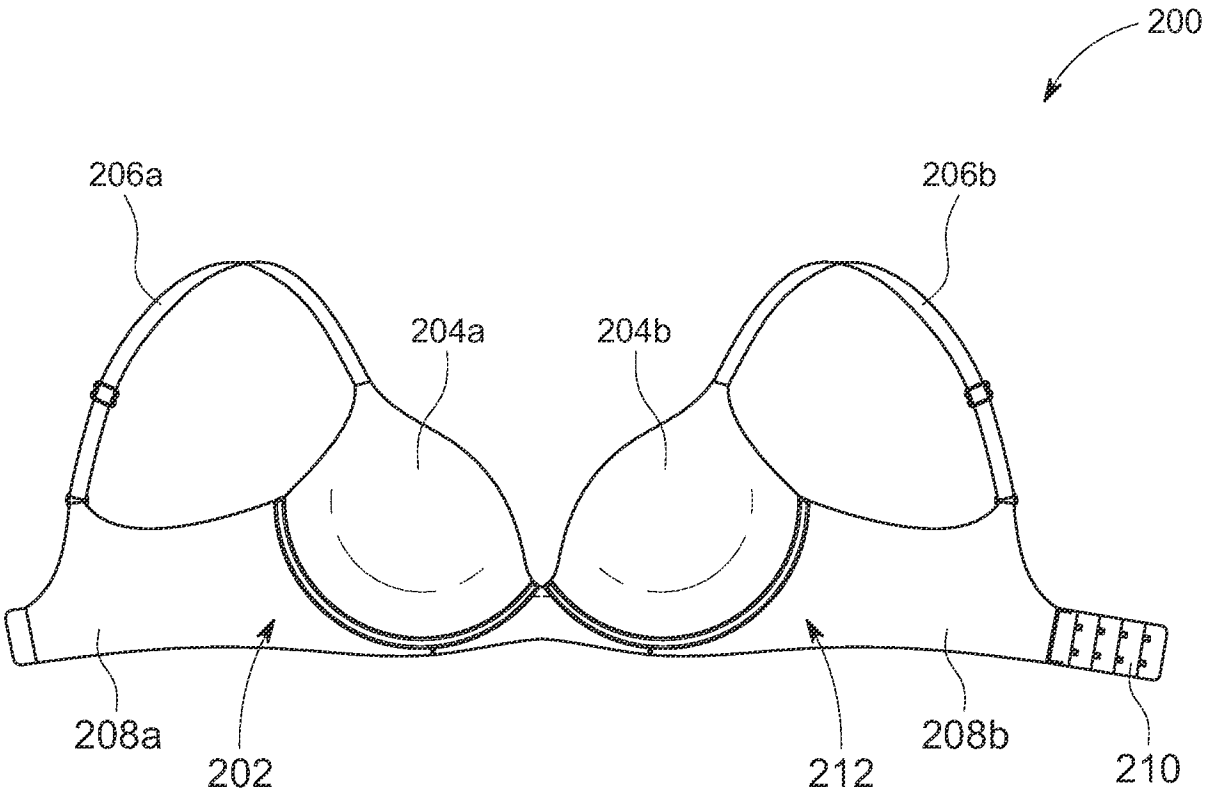
FIG. 5 illustrates a diagrammatic view of a brassiere, in accordance with a second embodiment of the present disclosure.

Referring to FIG. 5, illustrates is a diagrammatic view of a bra 200, in accordance with a second embodiment of the present disclosure. In particular, FIG. 5 illustrates a body structure 202 of the bra 200. As illustrated, the body structure 202 defines two bra cups that are generally identical to each other and are positioned adjacent to each other. As shown in FIG. 5, the body structure 202 includes a pair of bra cups, with a first bra cup 204*a* and a second bra cup 204*b* (sometimes commonly referred by the numeral 204 hereinafter). The bra 200 includes a pair of straps, including a first strap 206*a* and a second strap 206*b*. As illustrated, the first strap 206*a* and the second strap 206*b* are attached to top peripheries of the first bra cup 204*a* and the second bra cup 204*b*, respectively. Further, the bra 200 includes a pair of side wings, including a first side wing 208*a* and a second side wing 208*b* (sometimes commonly referred by the numeral 208 hereinafter). As illustrated, the first side wing 208*a* and the second side wing 208*b* are attached to lateral peripheries of the first bra cup 204*a* and the second bra cup 204*b*, respectively. As discussed previously, the pair of straps 208*a* and 208*b* support the bra 200 on shoulders of the wearer, while the pair of side wings 208*a* and 208*b* support the bra 200 around a torso of the wearer, when worn. In some examples, the pair of straps 208*a* and 208*b* may not be provided and only the pair of side wings 206*a* and 206*b* may support the bra 200 on the wearer. Further, in one or more examples, a fastener 210 may be provided with each of the first strap 206*a* and the second strap 206*b*.

Figure 6B:
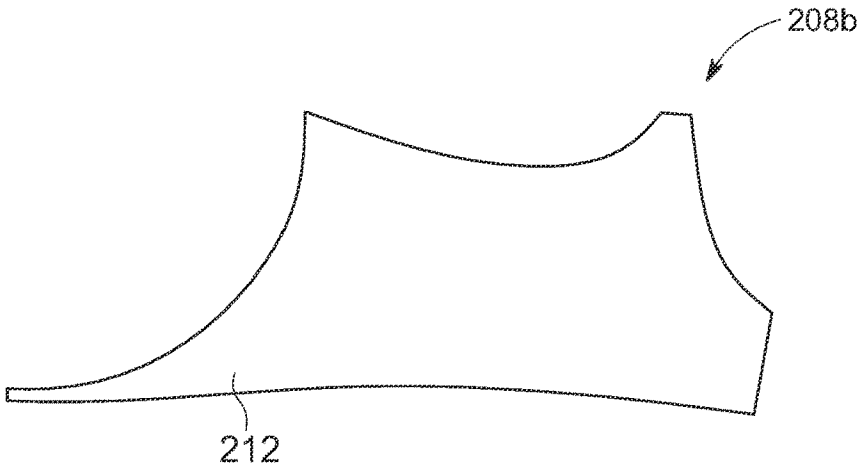
FIGS. 6A-6B illustrate diagrammatic views of side wings of the brassiere of FIG. 5, in accordance with an embodiment of the present disclosure.
Figure 6A:
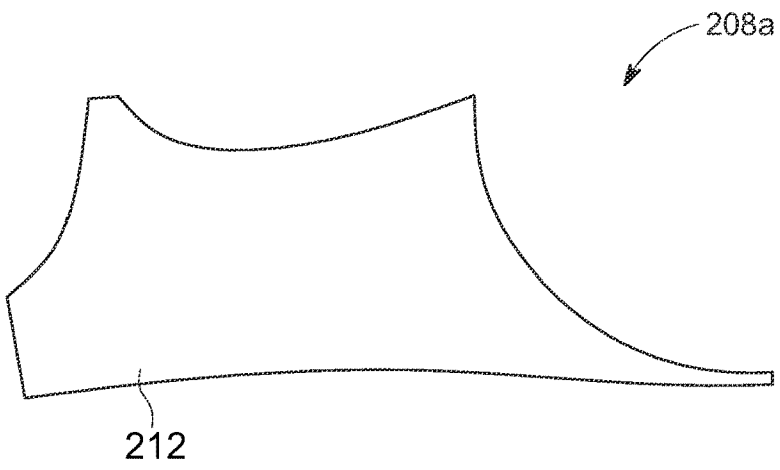
Figure 7:
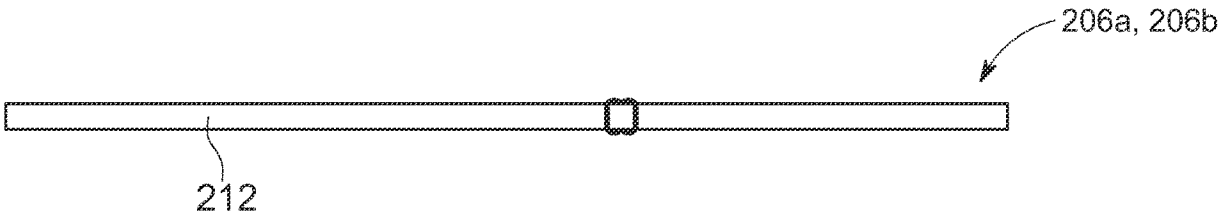
FIG. 7 illustrates a diagrammatic view of a strap of the brassiere of FIG. 5, in accordance with an embodiment of the present disclosure.

As discussed, at least one of the at least one side wing and the pair of straps comprise one or more flat-knit fabric layers. In the embodiment of FIG. 5, each of the first side wing 208*a* and the second side wing 208*b*, and further each of the first strap 206*a* and the second strap 206*b* are made of flat-knit fabric layer (generally represented by numeral 212) therein. Herein, the flat-knit fabric layer 212 is similar to the flat-knit fabric layer 114, as discussed above. In other words, in the illustration of FIGS. 6A and 6B, both the first side wing 208*a* and the second side wing 208*b*, respectively, are entirely made of the flat-knit fabric layer 212. It may be appreciated that the flat-knit fabric layer 212 is cut or knitted into the shape of the first side wing 208*a* and the second side wing 208*b*, as required. Further, in the illustration of FIG. 7, the first strap 206*a* (as well as the second strap 206*b*) is entirely made of the flat-knit fabric layer 212. Again, it may be appreciated that the flat-knit fabric layer 212 is cut or knitted into the shape of the first strap 206*a* (as well as the second strap 206*b*), as required.

Figure 8:
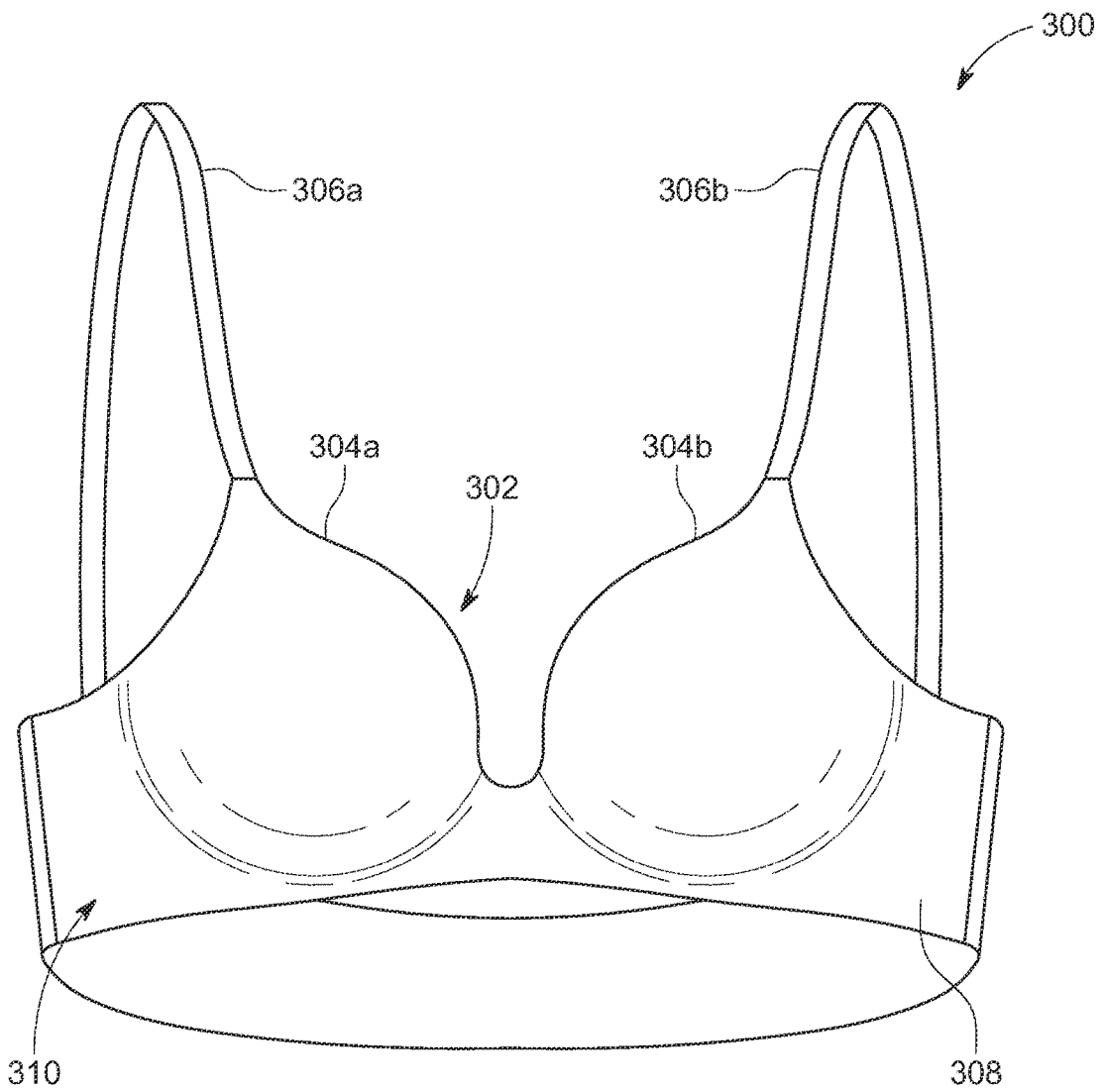
FIG. 8 illustrates a diagrammatic view of a brassiere, in accordance with a third embodiment of the present disclosure.

Referring to FIG. 8, illustrated is a diagrammatic view of a bra 300, in accordance with a third embodiment of the present disclosure. In particular, FIG. 8 illustrates a body structure 302 of the bra 300. As illustrated, the body structure 302 defines two bra cups that are generally identical to each other and are positioned adjacent to each other. As shown in FIG. 5, the body structure 302 includes a pair of bra cups, with a first bra cup 304*a* and a second bra cup 304*b* (sometimes commonly referred by the numeral 304 hereinafter). The bra 300 includes a pair of straps, including a first strap 306*a* and a second strap 306*b*. As illustrated, the first strap 306*a* and the second strap 306*b* are attached to top peripheries of the first bra cup 304*a* and the second bra cup 304*b*, respectively. Further, the bra 300 includes a side wing 308. As may be seen, the side wing 308 circles around the body structure 302 and is attached to lateral peripheries of the first bra cup 304*a* and the second bra cup 304*b*. Herein, the pair of straps 306*a* and 306*b* support the bra 300 on shoulders of the wearer, while the side wing 308 supports the bra 300 around a torso of the wearer, when worn.

Figure 9:
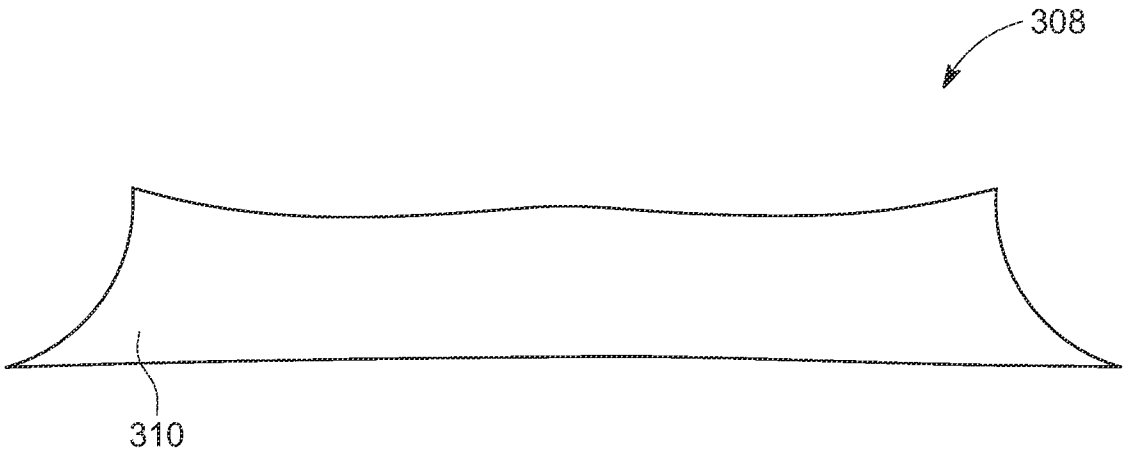
FIG. 9 illustrates a diagrammatic view of a side wing of the brassiere of FIG. 8, in accordance with an embodiment of the present disclosure.
Figure 10:
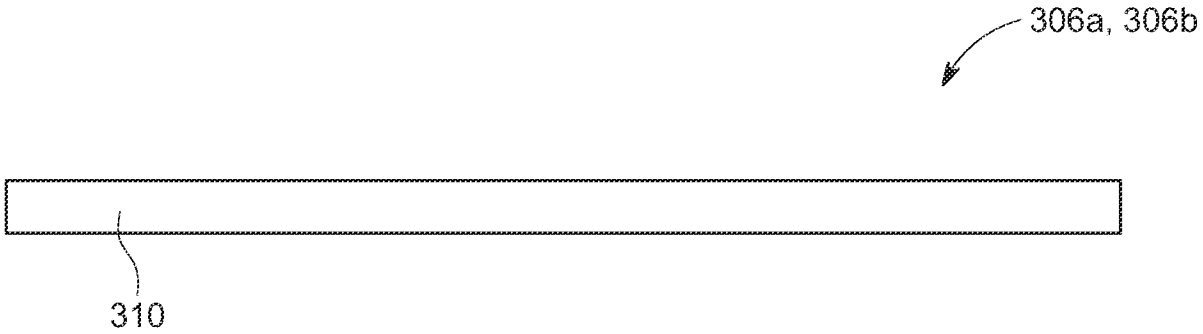
FIG. 10 illustrates a diagrammatic view of a strap of the brassiere of FIG. 8, in accordance with an embodiment of the present disclosure.

As discussed, at least one of the side wing and the pair of straps comprise one or more flat-knit fabric layers. In the embodiment of FIG. 8, the side wing 308, and each of the first strap 306*a* and the second strap 306*b* are made of flat-knit fabric layer (generally represented by numeral 310) therein. Herein, the flat-knit fabric layer 310 is similar to the flat-knit fabric layer 114 as well as the flat-knit fabric layer 212, as discussed above. In the illustration of FIG. 9, the side wing 308 is entirely made of the flat-knit fabric layer 310. It may be appreciated that the flat-knit fabric layer 310 is cut or knitted into the shape of the side wing 308, as required. Further, in the illustration of FIG. 10, the first strap 306*a* (as well as the second strap 306*b*) is entirely made of the flat-knit fabric layer 310. Again, it may be appreciated that the flat-knit fabric layer 310 is cut or knitted into the shape of the first strap 306*a* (as well as the second strap 306*b*), as required.

Figure 11:
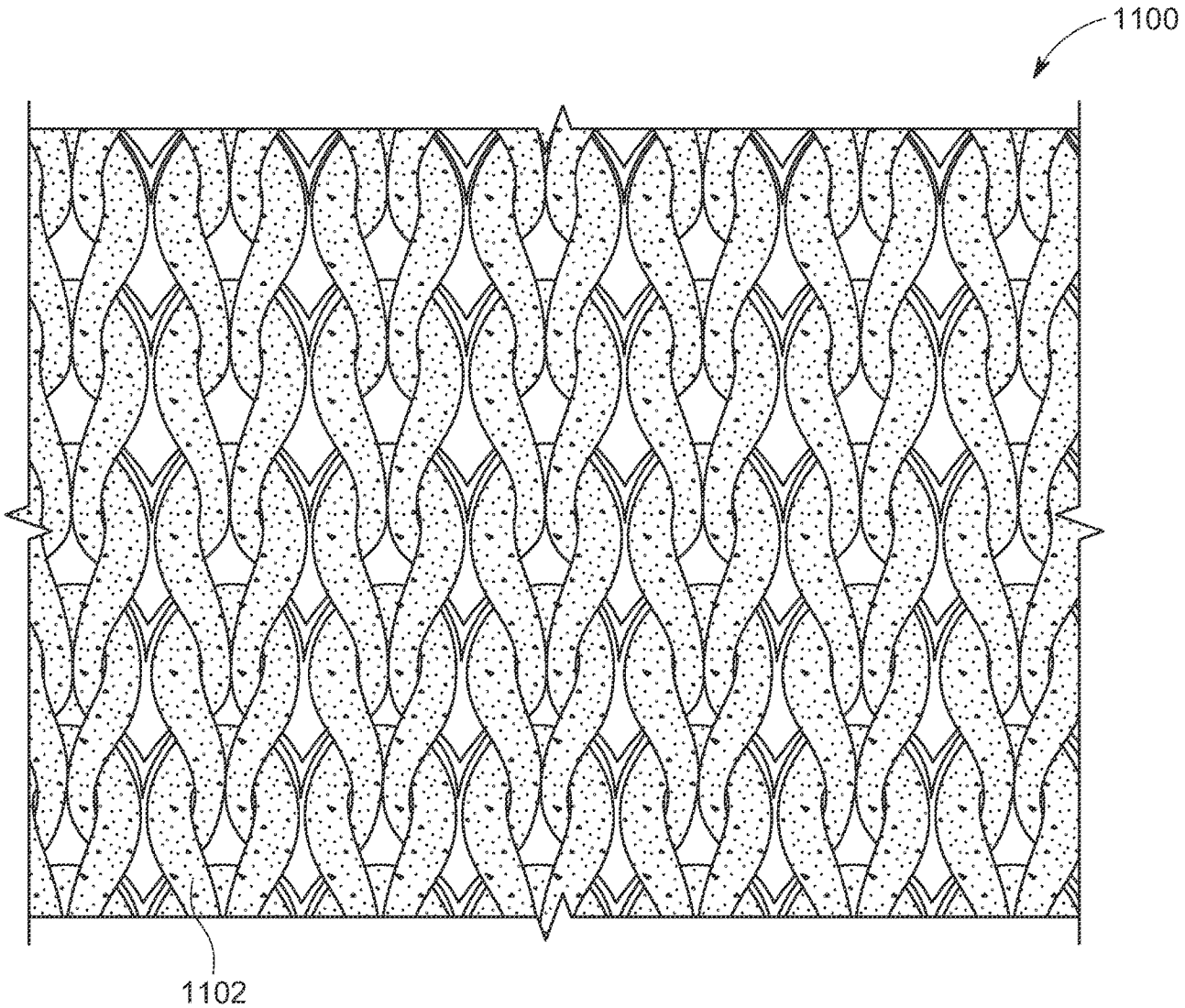
FIG. 11 illustrates a diagrammatic zoomed-up view of a section of one of a side wing and a strap of the brassiere of any of FIGS. 1, 5 and 8, in accordance with one or more embodiments of the present disclosure.

Referring now to FIG. 11, illustrated is a diagrammatic zoomed-up view of a section 1100 of one of a side wing and a strap of the bra, such as one of the side wing 110 and the strap 108 of the bra 100 of FIG. 1, one of the side wing 208 and the strap 206 of the bra 200 of FIG. 5 or one of the side wing 308 and the strap 306 of the bra 300 of FIG. 8, in accordance with one or more embodiments of the present disclosure. Herein, the section 1100 is made of a flat-knit fabric layer. In embodiments of the present disclosure, the flat-knit fabric layer, including each of the one or more flat-knit fabric layers, that is the flat-knit fabric layer 114 implemented in the bra 100, the flat-knit fabric layer 212 implemented in the bra 200 as well as the flat-knit fabric layer 310 implemented in the bra 300, is composed of an elastic covered yarn material 1102. Preferably, each of the one or more flat-knit fabric layers 114, 212 and 310 is composed of nylon or spandex covered polyester yarn material.

Further, in some embodiments, an amount of the yarn material 1102 utilized for forming the section 1100 of each of the one or more flat-knit fabric layers varies for different sections. In other words, the flat-knit fabric layer, such as the flat-knit fabric layer 114, may have different section with different amounts of the yarn material therein. For example, the amount of yarn material can be increased in one or more of face, bottom and intermediate section of the flat-knit fabric layer 114, as implemented in one of the side wing 110 and the strap 108 of the bra 100. This may be implemented so as to adjust the thickness, and thereby elasticity of the flat-knit fabric layer 114 at that section, as will be discussed below in more detail.

Furthermore, in some embodiments, different types of yarn materials are utilized for forming different sections of each of the one or more flat-knit fabric layers. In other words, the flat-knit fabric layer, such as the flat-knit fabric layer 114, may have different section with different types of the yarn material therein. For example, the type of yarn material used in a face section of the side wing of the bra may be different from the type of yarn material used in a bottom section of the flat-knit fabric layer 114, as implemented in one of the side wing 110 and the strap 108 of the bra 100. In other examples, the flat-knit fabric layer may be composed of hybrid yarn. By the term "hybrid yarn" in the present disclosure is meant a composite yarn, which comprises fibers of at least two different materials. Examples may include and are not limited to: two yarns twisted around another; one core spun yarn twisted with another yarn; a plurality of different yarns, one of which, for example, embodies the core and the remainder is twisted around it; or two existing hybrid yarns twisted around one another. This may be implemented so as to achieve different hand feels at different sections of a component, such as the side wing or the strap, of the bra.

Figure 12:
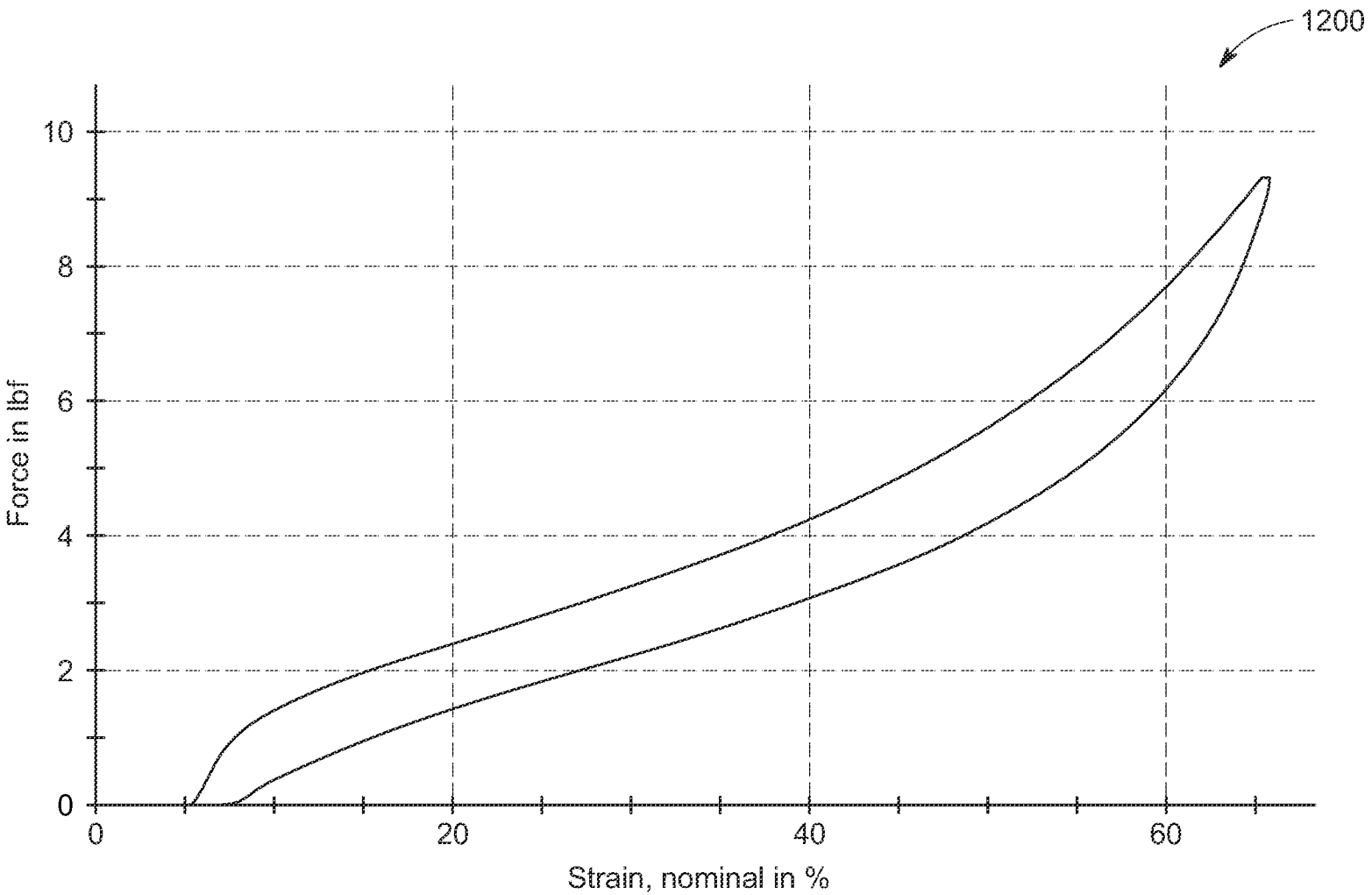
FIG. 12 illustrates a graph representing elongation in a conventional fabric material implemented in a strap of a typical bra.
Figure 13:
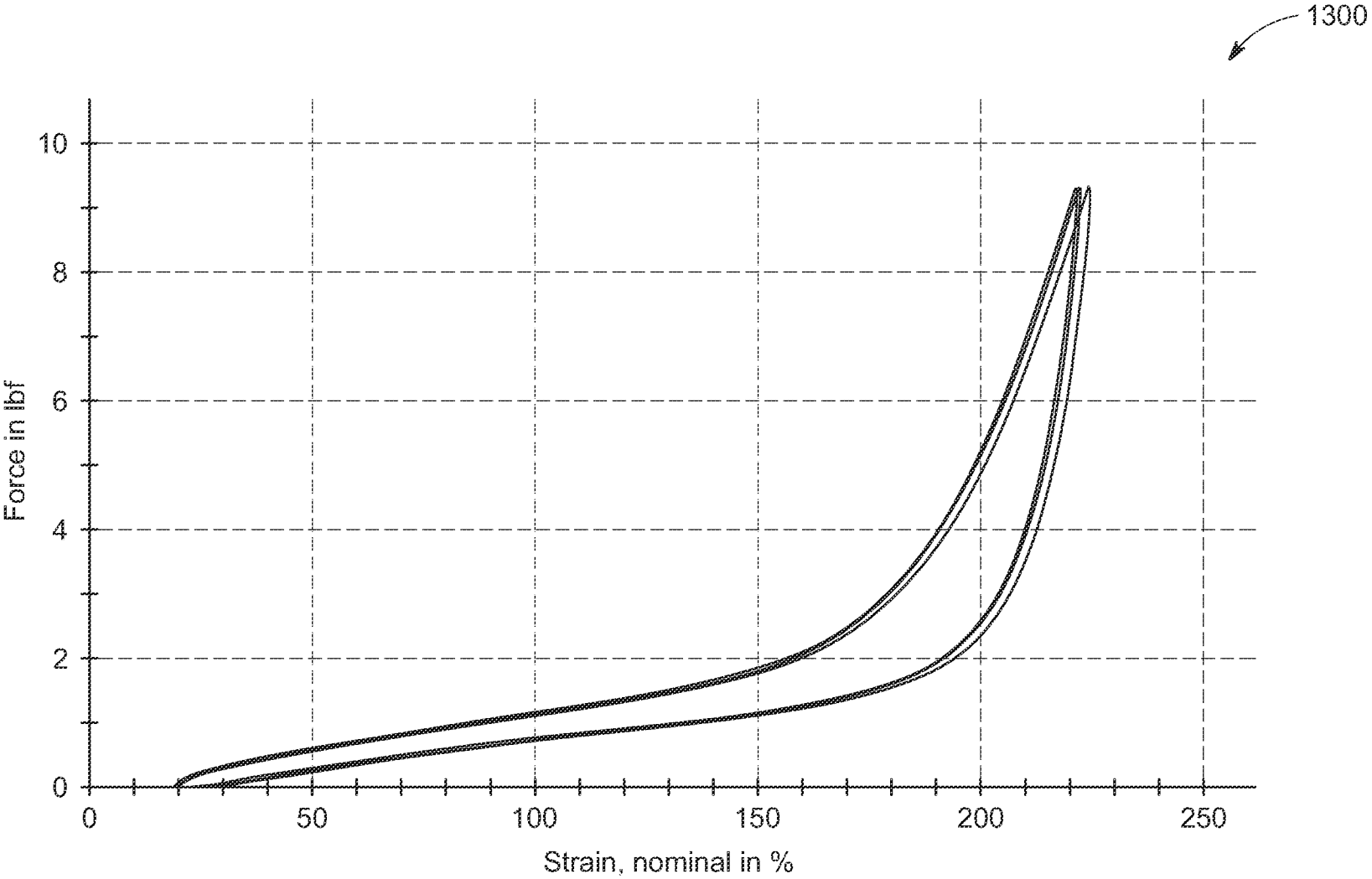

FIG. 12 illustrates a graph 1200 representing elongation in a conventional fabric material implemented in a strap of a typical bra. Further, FIG. 13 illustrates a graph 1300 representing elongation in fabric material implemented in a strap of a typical bra with the flat-knit fabric layer, such as the flat-knit fabric layer 114, therein. Herein, the upper curves in the graphs 1200 and 1300 corresponds to stretching of the respective, while the lower curves correspond to recovery (after stretching). It can be seen that under the same stretching forces, the strap implementing the flat-knit fabric layer 114 (with corresponding graph in FIG. 13) elongated to about 200% to 250% while the conventional strap (with corresponding graph in FIG. 12) elongated to only about 20% to 80%. Thus, it may be concluded that the flat-knit fabric layer, such as the flat-knit fabric layer 114, made of elastic covered yarn material allows for relatively more elongation to the fabric structure in any of the strap and the side wing of the bra formed thereby, as compared to same conventional fabric structure of the bra formed using traditional weaving techniques. Thereby, the flat-knit fabric layer 114 offers the advantage of a better comfort, better maneuverability and flexibility for the corresponding component of the bra 100.

The present disclosure further relates to a method of manufacturing a brassiere. The method comprises forming at least one side wing and a pair of straps, with each of the at least one side wing and each strap of the pair of straps comprising one flat-knit fabric layer therein. Herein, the method may first involve producing one or more flat-knit fabric layers with a flat-knit machine. As discussed, the term "flat-knit" represents a knitted fabric, obtained by a machine with one or two needle beds, a so-called flat knitting machine. In one embodiment, forming each of the at least one side wing comprises folding a fabric sheet to provide a folded region and a free ends region, with the flat-knit fabric layer enclosed within the folded region; and attaching the flat-knit fabric layer to the fabric sheet at the folded region and the free ends of the fabric sheet at the free ends region using an adhesive. In one embodiment, forming each strap of the pair of straps comprises folding a fabric sheet to provide a tubular structure, with the flat-knit fabric layer enclosed within the tubular structure of the fabric sheet; and attaching the flat-knit fabric layer to the fabric sheet using an adhesive. In one or more embodiments, the method further comprises varying an amount of yarn material in different sections of the flat-knit fabric layers. In one or more embodiments, the method further comprises utilizing different yarn materials in different sections of the flat-knit fabric layers.

The method further comprises providing a pair of bra cups. The bra cups may be manufactured using conventional techniques, known in the art. The method further comprises attaching the at least one side wing to lateral peripheries of the pair of bra cups to support the brassiere around a torso of the wearer, when worn. The method further comprises attaching the pair of straps to top peripheries of the pair of bra cups to support the brassiere on shoulders of the wearer, when worn. The various techniques for attaching the side wings and straps are also well known in the art and thus have not been described herein for the brevity of the present disclosure. It may be appreciated that any suitable attaching technique may be implemented depending on the type of bra to be manufactured, without any limitations.

It may be appreciated that with conventional shoulder straps and side wings, wearers of a particular bra cup size may be of such a body size that they may feel that the straps and wings are too tight, because of the force required to elongate the shoulder strap or side wing to a required extent for proper fit of the bra on their body. For a flat-knitted shoulder strap or side wing, however, it has been found that wearers of different body sizes wearing a particular bra cup size would likely still feel comfortable despite the different body sizes, because of the relatively smaller force required to elongate the shoulder strap or side wing to the required extent for proper fit of the bra on their body.

Generally, the teachings of present disclosure can be applied for any upper-torso garment which may be configured to cover an upper-torso of a wearer. In the present embodiments, the illustrated upper-torso garment is a bra, and the style of bra depicted is sometimes referred to as a sports bra, athletic bra, or other similar designation. And in other aspects of this disclosure, an upper-torso garment may include various other types of garments for a female or male, including a strapless bra, a camisole, a base-layer shirt, a singlet, a racing suit, and the like without departing from the scope of the present disclosure.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A brassiere to be worn by a wearer, the brassiere comprising:

a pair of bra cups;

at least one side wing attached to lateral peripheries of the pair of bra cups to support the brassiere around a torso of the wearer, when worn; and a pair of straps attached to top peripheries of the pair of bra cups to support the brassiere on shoulders of the wearer, when worn, wherein the at least one side wing comprises one or more flat-knit fabric layers, and a fabric sheet folded to provide a folded region and a free ends region, the one or more flat-knit fabric layers enclosed within the folded region.

2. The brassiere as claimed in claim 1, wherein each strap of the pair of straps comprises a flat-knit fabric layer therein.

3. The brassiere as claimed in claim 2, wherein each strap in the pair of straps comprises a fabric sheet folded to provide a tubular structure, and wherein the one or more flat-knit fabric layers is enclosed within the tubular structure of the fabric sheet.

4. The brassiere as claimed in claim 3, wherein the one or more flat-knit fabric layers is attached to the fabric sheet using an adhesive.

5. The brassiere as claimed in claim 4, wherein the adhesive is in the form of an adhesive film arranged between the one or more flat-knit fabric layers and the fabric sheet.

6. The brassiere as claimed in claim 1, wherein the one or more flat-knit fabric layers is attached to the fabric sheet at the folded region using an adhesive.

7. The brassiere as claimed in claim 6, wherein the adhesive is in the form of an adhesive film arranged between the one or more flat-knit fabric layers and the fabric sheet.

8. The brassiere as claimed in claim 1, wherein free ends of the fabric sheet at the free ends region are attached to each other using an adhesive.

9. The brassiere as claimed in claim 1, wherein each of the one or more flat-knit fabric layers comprises an elastic covered yarn material.

10. The brassiere as claimed in claim 9, wherein each of the one or more flat-knit fabric layers comprises nylon or spandex covered polyester yarn material.

11. The brassiere as claimed in claim 9, wherein an amount of yarn material utilized for forming a section of each of the one or more flat-knit fabric layers varies for different sections.

12. The brassiere as claimed in claim 9, wherein different types of yarn materials are utilized for forming different sections of each of the one or more flat-knit fabric layers.

13. A method of manufacturing a brassiere to be worn by a wearer, the method comprising:

forming at least one side wing comprising a flat-knit fabric layer therein, by folding a fabric sheet to provide a folded region and a free ends region, with the flat-knit fabric layer enclosed within the folded region, and attaching the flat-knit fabric layer to the fabric sheet at the folded region and the free ends of the fabric sheet at the free ends region using an adhesive;

forming a pair of straps;

providing a pair of bra cups;

attaching the at least one side wing to lateral peripheries of the pair of bra cups to support the brassiere around a torso of the wearer, when worn; and attaching the pair of straps to top peripheries of the pair of bra cups to support the brassiere on shoulders of the wearer, when worn.

14. The method as claimed in claim 13, wherein forming each strap of the pair of straps comprises:

folding a fabric sheet to provide a tubular structure, with a flat-knit fabric layer enclosed within the tubular structure of the fabric sheet; and attaching the flat-knit fabric layer to the fabric sheet using an adhesive.

15. The method as claimed in claim 13, wherein the flat-knit fabric layer comprises an elastic covered yarn material.

16. The method as claimed in claim 15, wherein the flat-knit fabric layer comprises nylon or spandex covered polyester yarn material.

17. The method as claimed in claim 15 further comprising varying an amount of yarn material in different sections of the flat-knit fabric layers.

18. The method as claimed in claim 15 further comprising utilizing different yarn materials in different sections of the flat-knit fabric layers.

* * * * *